United States Patent [19]

Chanslor et al.

[11] 4,029,311

[45] June 14, 1977

[54] INVALID WALKER WITH BRAKES

[76] Inventors: Hal Chanslor, 435 S. Parker, Orange, Calif. 92668; Rodes C. Bullock, 119 W. Kanikaula, Apt. 104B, Hilo, Hawaii 96720; William H. Bullock, 435 S. Parker, Orange, Calif. 92668

[22] Filed: May 1, 1975

[21] Appl. No.: 573,731

[52] U.S. Cl. ..... 272/70.3; 188/29

[51] Int. Cl.[2] ..... A61H 3/00

[58] Field of Search ..... 272/70.3, 70.4, DIG. 3; 188/2 D, 29, 19, 20, 21, 176, 45, 30; 128/80 R; 280/200, 87.02 R, DIG. 4

[56] References Cited

UNITED STATES PATENTS

| | | | |
|---|---|---|---|
| 1,063,878 | 6/1913 | Hart | 188/21 X |
| 1,917,440 | 7/1933 | Finkbeiner et al. | 272/70.4 X |
| 2,077,569 | 4/1937 | Kish | 272/70.4 |
| 3,279,567 | 10/1966 | Kempel | 188/176 |
| 3,354,893 | 11/1967 | Schmerl | 188/45 |

*Primary Examiner*—Richard C. Pinkham
*Assistant Examiner*—T. Brown
*Attorney, Agent, or Firm*—Gausewitz, Carr & Rothenberg

[57] ABSTRACT

An invalid walker comprises a lightweight, rigid frame having improved steerability derived from a combination of uniquely steerable front casters having upwardly and forwardly slanted swivel shafts together with non-swiveling rear wheels that are independently and separately controlled by separate right and left-hand brakes. Simple, effective brakes for each wheel embody a tubing section held in place solely by a return spring and the hand-operated brake cable.

10 Claims, 7 Drawing Figures

INVALID WALKER WITH BRAKES

BACKGROUND OF THE INVENTION

The present invention relates to invalid walkers and more particularly concerns a walker of improved mobility, tracking and control.

Invalid walkers are a type of self-supporting crutch to support or aid in the support of a semi-ambulatory person. For purposes of mobility, it is desirable to provide such walker structures with wheels. On the other hand, because a firm, steady and movable support is required, such walker structures are made as three or four-legged crutches with non-rolling, ground-supporting rubber or rubber-like tips, being light enough to be easily lifted. Such non-rolling structures are employed because rolling or wheeled structures are considerably more difficult to control by a semi-ambulatory person. They may be hard to steer, hard to stop and difficult to retain in a stationary position. Frequently, such rolling support structures provide little or no sense of stability or security to the user, particularly by their failure to track or travel in a straight line when desired and their failure to accomplish ready, simple and reliable braking.

Accordingly, it is an object of the present invention to provide a mobile invalid walker that eliminates or minimizes the above-mentioned problems, and to enable a semi-ambulatory patient to regain the ability to walk normally.

SUMMARY OF THE INVENTION

In carrying out principles of the present invention in accordance with a preferred embodiment thereof, the rigid frame of an invalid walker has rear wheels mounted for rotation about fixed horizontal axes and means are provided for independently braking each of the wheels. According to another feature of the invention, the front of the walker is mounted upon castered wheels having swivel axes that incline upwardly and forwardly. Still another feature of the invention resides in a simple and effective brake wherein a braking cylinder is relatively loosely captured and held in place by the very structure which operates the cylinder between braking and release positions.

DETAILED DESCRIPTION

Figure 3:
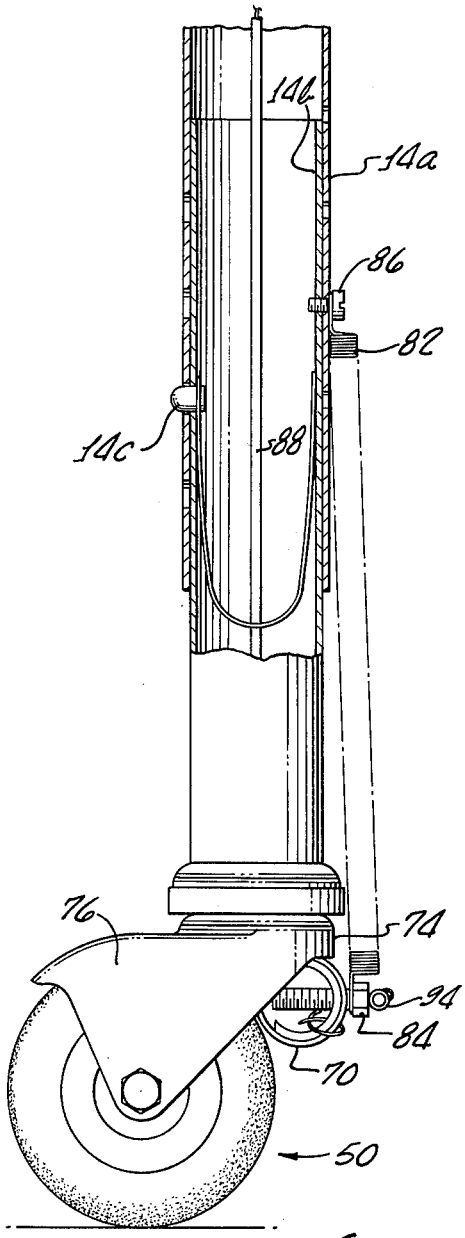
FIG. 3 is a side view with parts broken away of one of the rear posts showing the brake cylinder and return spring.
Figure 1:
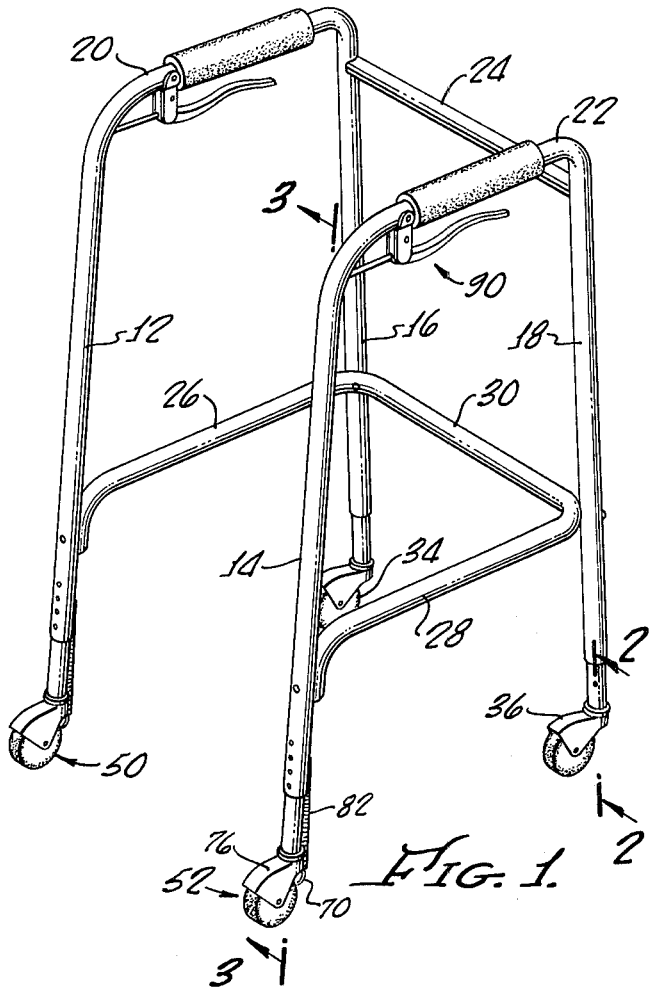
FIG. 1 is a perspective view of an invalid walker embodying principles of the present invention.
Figure 5:
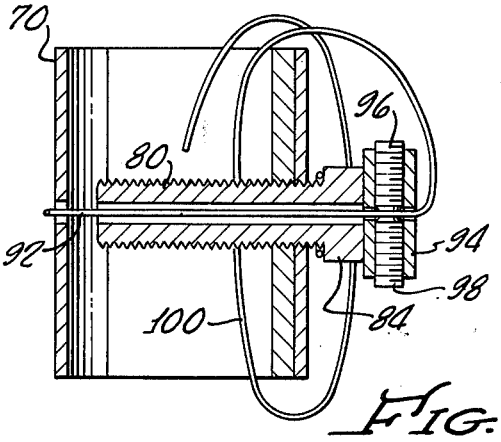
FIG. 5 is a section taken on line 5—5 of FIG. 4.

As illustrated in FIG. 1, the body of an invalid walker constructed in accordance with principles of the present invention includes a pair of side frames of inverted U-shape having first and second rigid rear posts 12, 14 and first and second rigid forward posts 16, 18, the pairs of rear and forward posts being interconnected by upper side support bars 20 and 22, respectively. An upper front bar 24 rigidly interconnects forward side posts 16, 18 to provide a front structure, and a horizontally extending U-shaped frame element provides first and second lower side bars 26, 28 and a lower forward bar 30 integrally connected with each other and fixedly connected to the several frame posts 12, 14, 16 and 18.

The described arrangement provides a compact, lightweight and rigid frame. It affords firm and reliable support at the front and at both sides for a semi-ambulatory person and still provides simple entry and exit through the completely open rear portion of the frame. If deemed necessary or desirable a seat (not shown) may be pivotally mounted to the frame for motion from a folded position wherein it does not interfere with use of the structure as a walker, and a lowered horizontal position for support of the user in seated position. It will be readily understood that the frame may be constructed in a number of different rigid skeletal configurations to provide these functions. Various foldable configurations are well known and also contemplated. The form illustrated in FIG. 1 is preferred. All of the posts are vertically adjustable as described in detail hereinafter.

A significant feature of the present invention is the combination of exceedingly easy and free motion of the entire frame together with stability, durability and precise rapid control, steering and stopping response are enhanced by a unique arrangement of swiveled and non-swiveled wheels together with a specific braking arrangement all of which combine for ease of motion and a simple, natural and rapid response of control.

The frame is provided with swiveled casters at its front and non-swiveling, independently controllable wheels at its back. Thus, the forward posts 16 and 18 each mounts a swiveled caster 34, 36. Brakes are neither needed or desired on the front casters. As more particularly illustrated in FIG. 2, caster 34, which is identical to caster 36 both in structure and mounting, comprises a wheel 38 mounted in a caster frame 40 that is rotatably carried by an upwardly extending caster stem 42 for swiveling rotation about the axis of the caster stem.

The stem is mounted in an aperture formed in a plug 46 fixed to and within the lower end of post 16. The swivel axis of the caster is upwardly and forwardly inclined and, to this end, the aperture in plug 46 itself is upwardly and forwardly inclined to correspondingly position the caster and its swivel axis.

The forward post may be vertical or have a slight downward and forward inclination. Nevertheless, the upward and forward inclination of the caster swivel axis is considerably greater than any inclination of the front post so that the caster axis does have a substantial forward and upward inclination relative to a vertical direction and not merely relative to the forward post.

The lower end of the post 16 and plug 46 are both cut at an angle corresponding to the angle of inclination of the swivel axis to thereby provide a close mating fit between the bottom of the post and plug and the upper surface of caster bearing race 48.

The inclination of the forward castor swivel axis is of particular importance in a lightweight structure where very low or small forces are downwardly exerted upon the caster. Castering action depends in part upon a force pressing the wheel against the ground. Where there is little or no force, the caster may tend to skid and wobble from side to side, particularly during a turn or near the end of a turning maneuver. Since the invalid walker may be moved along the ground without any pressure other than the relatively small pressure exerted by the very lightweight frame itself, castering action of a conventional caster may exhibit these undesirable characteristics. The described upward and forward inclination of the caster swivel axis of the front caster significantly alleviates this problem.

Figure 2:
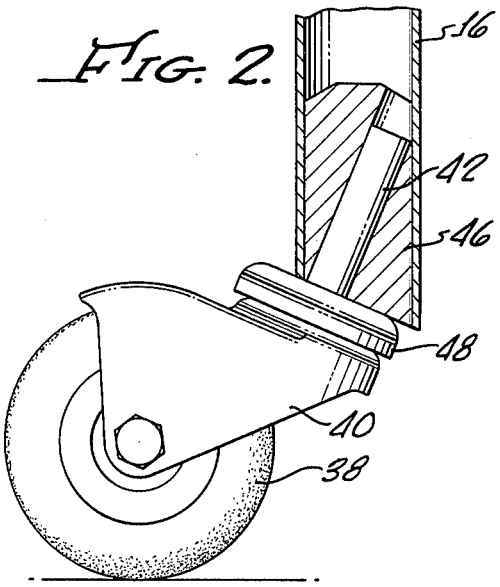
FIG. 2 is an enlarged sectional illustration of a lower end of one of the front posts illustrating the angled caster swivel axis.

The inclination of the caster swivel axes significantly increases the castering action of the conventional castered wheel. The caster is shown in FIG. 2 in its forwardly tracking direction (toward the right in the drawing). For the walker frame to move in any other direction than directly ahead, the casters 34, 36 must rotate about their swivel axes, which requires an upward displacement of the entire front of the structure. Therefore, the greater the downward force exerted on the front posts 16, 18 (as by a person using the walker), the better it will track.

Each of the rear posts 12 and 14 carries a non-swiveling braked wheel 50, 52, respectively. Illustrated in FIGS. 3 through 7 are details of one of the rear wheels, wheel 52, and its independent brake. This wheel and its brake are identical to the wheel 50 and the brake therefor so that description of one will suffice to describe both. Wheel 52 is a conventional caster and may be a standard, off-the-shelf item similar to the casters forming the front wheel but with certain significant differences to be described.

Figures 4, 6, 7:
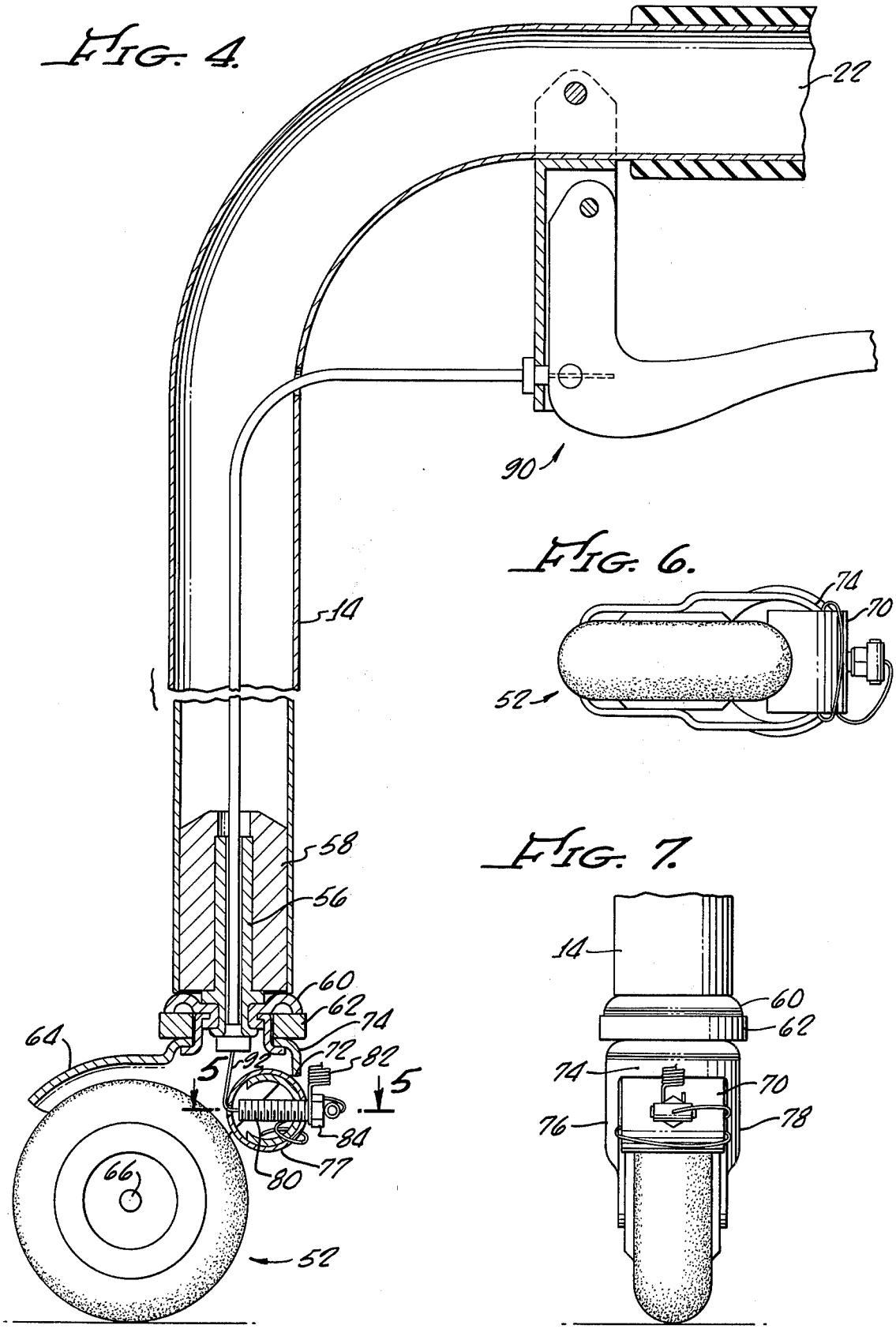
FIG. 4 is a sectional view of the rear post showing the brake operating cable and details of the brake.
FIG. 6 is a view of the bottom of the rear wheel showing the brake structure.
FIG. 7 is a view of the front of the rear wheel and brake assembly.

The rear wheel caster has its swivel stem 56 aligned with the axis of rear post 14 and is thus conventionally carried in a substantially vertical or upright position within a plug 58 fixed to and within the bottom of post 14 (see FIG. 4). A further difference of the rear wheel is the fact that it is non-swiveling. That is, the wheel will rotate only about a horizontal axis that is fixed with respect to the post 14. There are many constructions of fixed axis, non-swiveling wheels which may be used, as well-known to those skilled in the art. Conveniently, as employed in the exemplary embodiment illustrated in the drawings, the rear wheel is formed of a conventional castered wheel wherein the bearing balls of race 60 are replaced by a fixed washer 62. The wheel is journalled in conventional caster frame 64 about a horizontal fixed axis 66. The use of washer 62 between race 60 and frame 64 is merely a convenient way to employ a basically conventional caster as a common wheel having no swiveling action. This washer prevents rotation of the frame 64 about the caster stem 58.

Independent restraint of the rear wheel 52, independent of the braking of the other rear wheel 50, is achieved by a braking cylinder conveniently formed as a short section of hollow tubing 70 that is fulcrumed at and against a lower edge 72 of a forward depending skirt 74 of caster frame 64.

The forward depending skirt 74 of the caster frame curves in a horizontal plane as it extends outwardly and rearwardly to join the downwardly extending frame side walls 76, 78. Brake cylinder 70 has a length slightly less than the distance between side walls 76, 78 and is captured therebetween. The brake cylinder is fulcrumed at two points, one on each end thereof, on the lower edge 72 of the curved skirt 74, these points being spaced forwardly and upwardly from the periphery of the wheel along a radius of the wheel. Brake cylinder 70 is free of connection with the caster and its frame. Lateral motion of the brake cylinder is restrained by side walls 76, 78. Forward motion is restrained by skirt 74 and rearward motion is limited by the wheel. The brake cylinder is held in place by the very structure which operates the cylinder between braking and release position.

A brake return lever in the form of an axially apertured headed bolt 80 is threaded into cylinder 70 (which may be reinforced and thickened at this point) and extends radially outwardly thereof in a forward direction with respect to the walker. Interconnected between the free forward end of bolt 80 and the rear post 14 is a brake return tension spring 82 that tends to move the brake cylinder 70 forwardly (to the right as illustrated in FIG. 4) pivoting the cylinder in a counterclockwise direction about its fulcrums 72. Spring 82 has one end connected to the bolt between the cylinder and a head 84 on the bolt.

The other end of spring 82 is connected to a bolt 86 (FIG. 3) threaded in the outer sleeve **14*a* of two concentric telescoping sleeves 14*a*, 14*b* that permit vertical adjustment of the rear post 14. Spring pressed detents 14*c* permit and retain the vertical height adjustment. Bolt 86 is threaded in outer sleeve 14*a* and rides in a slot (not shown) that extends vertically in inner sleeve 14*b* to permit vertical adjustment without disconnecting brake return spring 82. It may be noted that all four of the posts are formed with a pair of telescoping sleeves and detent adjustment means identical to the vertical height adjustment arrangement of post 14.**

A brake cable sheath 88 (FIGS. 3, 4) extends through the post 14, through an aperture in caster stem 56 and from the top of plug 58 to a conventional caliper type handbrake operator 90 mounted on the side member 22. Within the sheath 88 is a brake cable 92 connected at its upper end to the caliper brake operator. At its lower end, cable 92 extends through the axial aperture in bolt 80 and through a diametrical aperture in an internally threaded sleeve 94 (FIG. 5) welded to the bolt head 84. A pair of opposed set screws 96, 98 are threaded into sleeve 94 to grip cable 92 and hold it in adjusted position. The brake cable must be lengthened or shortened to accommodate vertical adjustment of the rear posts. Therefore, the cable has a relatively long free end 100 which is coveniently wrapped around the brake cylinder when the walker is in a lower position of vertical adjustment.

It will be seen that the brake cylinder is free of connection with the post and wheel but is merely retained against its fulcrums 72 by the combined action of the brake operating cable 92 and return spring 82. The latter urges the brake cylinder forwardly, in a direction away from the periphery of the wheel. When the hand caliper brake is operated, tension in cable 92 pivots the brake cylinder about its fulcrums 72 in a clockwise direction as viewed in FIG. 4. This moves the brake toward and against the periphery of the wheel and thus restrains rotation of the wheel. Upon release of the hand caliper brake, the return spring releases the brake cylinder from the wheel and the latter is again freely rotatable about its fixed axis 66.

As previously indicated, the arrangement of the structure of the mounting and braking of the other rear wheel, wheel 52, is identical with that of wheel 50, wheel 52 being restrained by a brake cylinder arrangement identical to and independent of that described above.

The described arrangement of wheels and braking provides for improved smoothness, simplicity, durability and control. The inclined swivel axes of the forward casters increase the castering action available from conventional off-the-shelf casters and thus ensure improved wobble-free or oscillation-free tracking of these wheels. Concomitantly, the fixed axis rear wheels enhance the steerability, ensuring straight line tracking. Further, by virtue of their independent braking, the rear wheels enable rapid precision turns. Thus, operation of one of the hand brakes with a continued forward urging of the walker will cause the entire apparatus to immediately pivot as a unit about that one of the rear wheels which has been stopped. Operation of both of the brakes at the same time will immediately stop all forward motion of the apparatus. The walker may be quickly and readily stopped or turned to one side or the other but, at the same time, the combination of forward caster wheels and rear non-swiveling wheels facilitates tracking of the walker in a straight line or such other path as may be chosen by the person supported by the apparatus.

A significant feature of the described brake is its self-adjusting characteristic. The brake cylinder is relatively loosely held with its center offset rearwardly from the lower forward edge 72 of the caster frame which provides the fulcrums for the brake cylinder. Thus, the brake cylinder is captured in effect between the wheel and the forward skirt of the caster frame. Should the brake cable 92 be loosened to some extent, return spring 76 will operate to take up the brake cable slack by readjusting the disengaged position of the brake cylinder, moving the latter forwardly about its fulcrums 72. Nevertheless, within a significant range of adjustment of the brake cable 92 the return spring 76 will continuously operate to retain and maintain the brake cylinder 70 in firm engagement against the fulcrums 72. As long as the cylinder center remains offset rearwardly of the point of the fulcrum, the brake cylinder will remain operable. Accordingly, it is significant that the cable 86 have a maximum length with the hand caliper lever in release position such that the brake cylinder center remains offset rearwardly from fulcrums 72 while the return spring 76 is exerting a tensile force on the end of return lever 74.

Another significant feature of the illustrated brake is the fact that in the most common operation of the walker, namely, motion in the forward direction, inadvertent contact of the brake cylinder 70 with the wheel is such as to tend to move the brake cylinder 70 downwardly and away from the wheel whereby the brake cylinder will not inadvertently restrain rotation of the wheel. This feature results from the specific location and mounting arrangement of the brake cylinder. In particular, it is noted that the brake cylinder is mounted forwardly of the wheel and thus will be moved away from the wheel by normal forward rotation thereof in the absence of the tensile force exerted by the cable 92. For the same reason, namely, the forward location of the brake cylinder with respect to the wheel, braking of the wheels against a tendency toward rearward motion of the vehicle or walker (e.g. a braking against counter-clockwise rotation of wheel 66 as viewed in FIG. 3) is greatly enhanced. Such a rotational direction of the wheel will tend to lock the brake cylinder to and between the periphery of the wheel and its fulcrums 72, since the diameter of the brake cylinder 70 is chosen to be greater than the distance between the fulcrums 72 and the periphery of the wheel.

The foregoing detailed description is to be clearly understood as given by way of illustration and example only, the spirit and scope of this invention being limited solely by the appended claims.

What is claimed is:

1. A steerable invalid walker comprising
a front structure,
means for movably supporting the front structure,
first and second rear posts,
first and second mutually spaced side structures respectively interconnecting said first and second posts with said front structure,
first and second wheels rotatably carried at lower ends of said first and second posts, respectively, for rotation about substantially horizontal axes fixed relative to said posts, and
means for independently restraining rotation of said first and second wheels,
one of said wheels including a frame having a depending skirt,
said means for restraining motion of at least one of said first and second wheels comprising a cylindrical braking element positioned below and against a lower edge of said skirt and in close proximity to the periphery of said one wheel, whereby said cylindrical braking element is fulcrumed against said skirt, said braking element being free of connection with said wheel frame, and means for forcibly pivoting said braking element upon said fulcrum to press said braking element against the periphery of said wheel.

2. The invalid walker of claim 1 wherein said skirt includes a forward depending lip spaced forwardly and upwardly from the periphery of said one wheel along a radius thereof, the space between said lip and the periphery of said one wheel being less than the diameter of said braking element.

3. The invalid walker of claim 1 wherein the center of said cylinder is positioned between said fulcrum and the periphery of said wheel.

4. The invalid walker of claim 1 wherein said means for pivoting the braking element comprises a brake cable connected to said cylindrical element and extending upwardly through the post on which said one wheel is mounted, and lever means mounted to one of said side structures and connected to said cable for tensioning said cable means.

5. The invalid walker of claim 4 including a return lever fixed to said cylindrical braking element and extending radially outwardly thereof, said spring means interconnected between an outwardly extending end of said return lever and said post.

6. The invalid walker of claim 4 including an axially apertured bolt threaded into said element, an apertured internally threaded sleeve fixed to an end of said bolt, said cable extending through said bolt and through said sleeve and a pair of mutually opposed screws threaded into said sleeve from opposite ends thereof and clamping said cable therebetween.

7. An invalid walker comprising
a substantially rigid open frame having
first and second forward posts,
a front structure fixedly interconnecting said forward posts,
first and second rear posts, first and second side structures fixedly interconnecting said first forward and rear posts and said second forward and rear posts respectively, first and second swiveled casters mounted at lower ends of said forward posts, respectively, first and second non-swiveling wheels mounted at lower ends of said first and second rear posts, respectively, and means for independently braking said rear wheels, one of said rear wheels including a frame mounted to one of said posts and having a forward depending skirt, said means for braking said one rear wheel comprising a cylindrical braking element having a substantially horizontal axis, said braking element being positioned in abutment with a lower edge of said skirt whereby said braking element is fulcrumed at and against said lower edge and positioned closely adjacent the periphery of one of said rear wheels, said braking element being free of direct connection with said one post, and means for holding said braking element in position upon said fulcrum and for moving said braking element between braking and release positions, said last-mentioned means comprising spring means interconnected between said one post and said braking element for urging said braking element in a first direction about its fulcrum, and brake applying means interconnected between an opposite side of said braking element and one of said side structures for urging said braking element in an opposite direction around its fulcrum into engagement with the periphery of said one rear wheel.

8. The invalid walker of claim 7 wherein said wheel frame includes a pair of downwardly extending side walls, said braking element comprising a diametrically apertured circular cylindrical section extending longitudinally between said side walls and radially between said frame skirt edge and the periphery of said one wheel, a braking cable extending through said one post and through the aperture of said cylindrical section, means for securing an end portion of said cable to a forward side of said cylindrical section, and brake return means comprising a tension spring connected between said post and said forward side of said cylindrical section.

9. An invalid walker comprising a substantially rigid open frame having first and second forward posts, a front structure fixedly interconnecting said forward posts, first and second rear posts, first and second side structures fixedly interconnecting said first forward and rear posts and said second forward and rear posts respectively, first and second swiveled casters mounted at lower ends of said forward posts, respectively, first and second non-swiveling wheels mounted at lower ends of said first and second rear posts, respectively, means for independently braking said rear wheels, one of said rear wheels including a frame having a depending skirt, and said means for braking comprising a braking element positioned below and against a lower edge of said skirt and in close proximity to the periphery of said one wheel, whereby said braking element is fulcrumed against said skirt, said braking element being free of connection with said wheel frame, and means for forcibly pivoting said braking element upon said fulcrum to press said braking element against the periphery of said one wheel.

10. The invalid walker of claim 9 wherein said braking element is a cylinder, and wherein said skirt includes a forward depending lip spaced forwardly and upwardly from the periphery of said one wheel along a radius thereof, the space between said lip and the periphery of said one wheel being less than the diameter of said braking element.

* * * * *